US007437780B2

(12) United States Patent
Lin

(10) Patent No.: US 7,437,780 B2
(45) Date of Patent: Oct. 21, 2008

(54) SHOWER APPARATUS USING SAVED SPACE

(75) Inventor: Chun-Hui Lin, Taipei (TW)

(73) Assignee: Hocheng Corporation, Taipei (TW)

( * ) Notice: Subject to any disclaimer, the term of this patent is extended or adjusted under 35 U.S.C. 154(b) by 0 days.

(21) Appl. No.: 11/647,156

(22) Filed: Dec. 29, 2006

(65) Prior Publication Data

US 2008/0141453 A1 Jun. 19, 2008

(51) Int. Cl.
*A47K 3/022* (2006.01)
*A47K 3/28* (2006.01)

(52) U.S. Cl. ..... 4/596; 4/601

(58) Field of Classification Search ..... 4/596, 4/599–601, 607, 609, 614
See application file for complete search history.

(56) References Cited

U.S. PATENT DOCUMENTS

| | | | | | |
|---|---|---|---|---|---|
| 5,070,549 | A | * | 12/1991 | Campe | 4/596 |
| 5,092,002 | A | * | 3/1992 | Powers | 4/596 |
| D335,352 | S | * | 5/1993 | Ristine, III | D24/201 |
| 5,287,569 | A | * | 2/1994 | Johnson | 4/599 |
| 5,446,930 | A | * | 9/1995 | Clark | 4/599 |
| D380,528 | S | * | 7/1997 | D'Andrea | D23/283 |
| 7,013,504 | B2 | * | 3/2006 | Brunelle et al. | 4/597 |

* cited by examiner

*Primary Examiner*—Huyen Le
(74) *Attorney, Agent, or Firm*—Troxell Law Office, PLLC

(57) ABSTRACT

A shower apparatus occupies a small space. The shower apparatus uses a spray device to massage a whole body of a person. And the shower apparatus uses an illuminating device to obtain a relaxing atmosphere.

7 Claims, 4 Drawing Sheets

SHOWER APPARATUS USING SAVED SPACE

FIELD OF THE INVENTION

The present invention relates to a shower apparatus; more particularly, relates to assembling the shower apparatus with a saved space; and, by using spray device and illuminating device, massaging a whole body and obtaining a relaxing atmosphere.

DESCRIPTION OF THE RELATED ART

A prior art called "a constituted bathroom" comprises a roof, a base and a wall.

The roof comprises a first cover and a second cover at a side of the first cover, where the first cover has an extension at a side; and the second cover has a quirk at a side to hold the extension.

The base comprises a first basis and a second basis at a side of the first basis, where the first basis has an extended section at a side; the extended section has an assembling part at a side; the second basis has an assembled part at a side to connected with the assembling part; the first basis and the second basis each has a sinkhole; the first basis and the second basis each has an opening at a side; a plugging hole is located near the opening; the plugging hole has a floor drain; and the floor drain is as high as inner height of the first and the second bases.

The wall is set between the roof and the base; the wall comprises at least one wall plate and a plurality of wallboards bordering at the connecting parts of wall plates. Thus, a constituted bathroom of the prior art is obtained.

Although the above prior art constitutes a bathroom, the bathroom is big and has a complex structure; hence, it takes a big space and is not constituted easily. Moreover, the bathroom, comprising the roof, the base and the wall, is rigid; and can not massage a whole body and create a relaxing atmosphere. Hence, the prior art does not fulfill users' requests on actual use.

SUMMARY OF THE INVENTION

The main purpose of the present invention is to assemble a shower apparatus with a saved space; and, by using spray device and illuminating device, to massage a whole body and to obtain a relaxing atmosphere.

To achieve the above purpose, the present invention is a shower apparatus using a saved space, comprising a base having an outlet; a frame having two ends, which are corresponding to two interior opposite angles on a surface of the base, a spray device and an illuminating device, which are both corresponding to the surface of the base; and a gate body against edges at two opposite sides of the frame. Accordingly, a novel shower apparatus using a saved space is obtained.

BRIEF DESCRIPTIONS OF THE DRAWINGS

The present invention will be better understood from the following detailed description of the preferred embodiment according to the present invention, taken in conjunction with the accompanying drawings, in which FIG. 1 is the perspective view showing the preferred embodiment according to the present invention;

DESCRIPTION OF THE PREFERRED EMBODIMENT

The following description of the preferred embodiment is provided to understand the features and the structures of the present invention.

Figure 1:
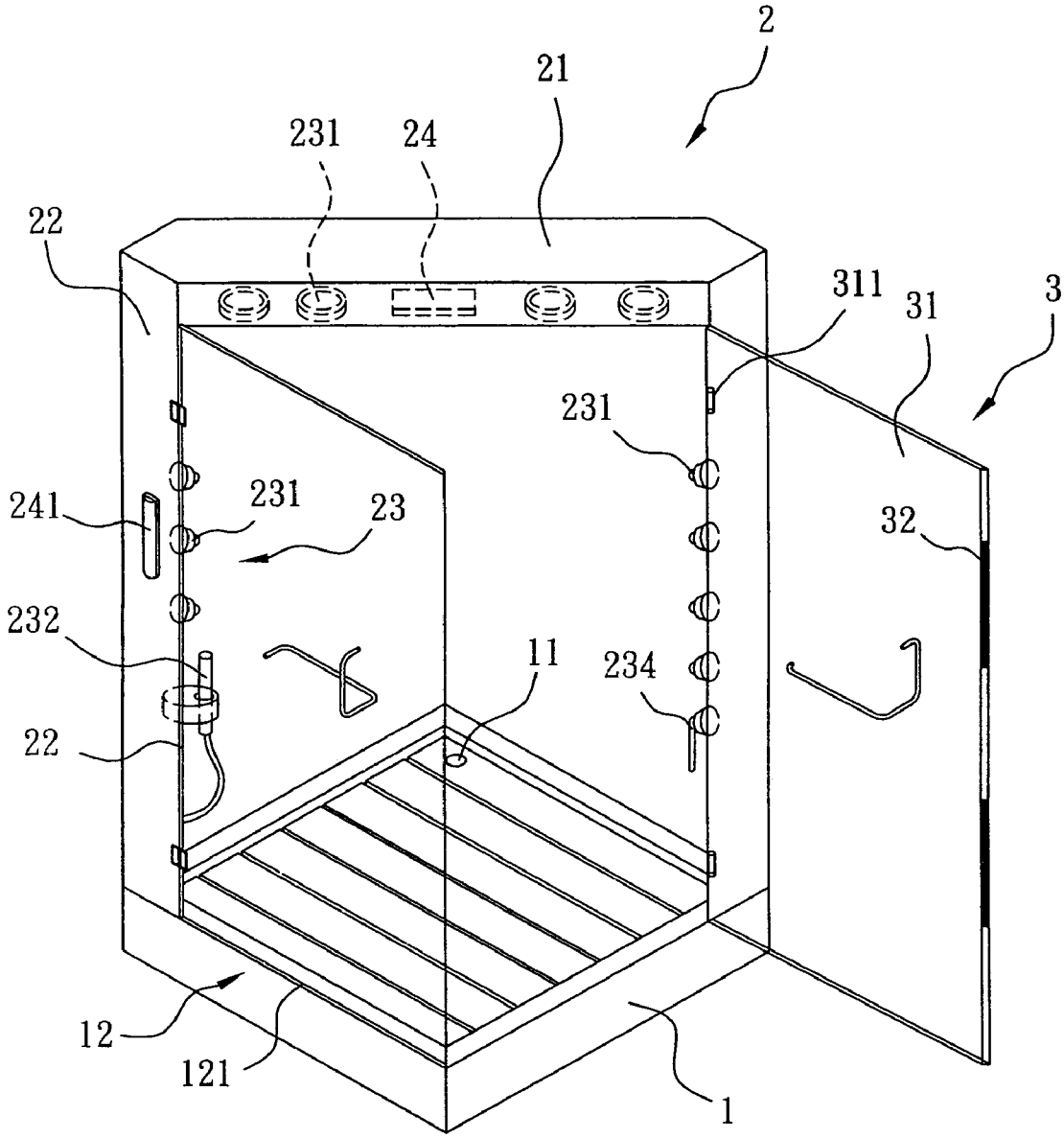
Figure 2:
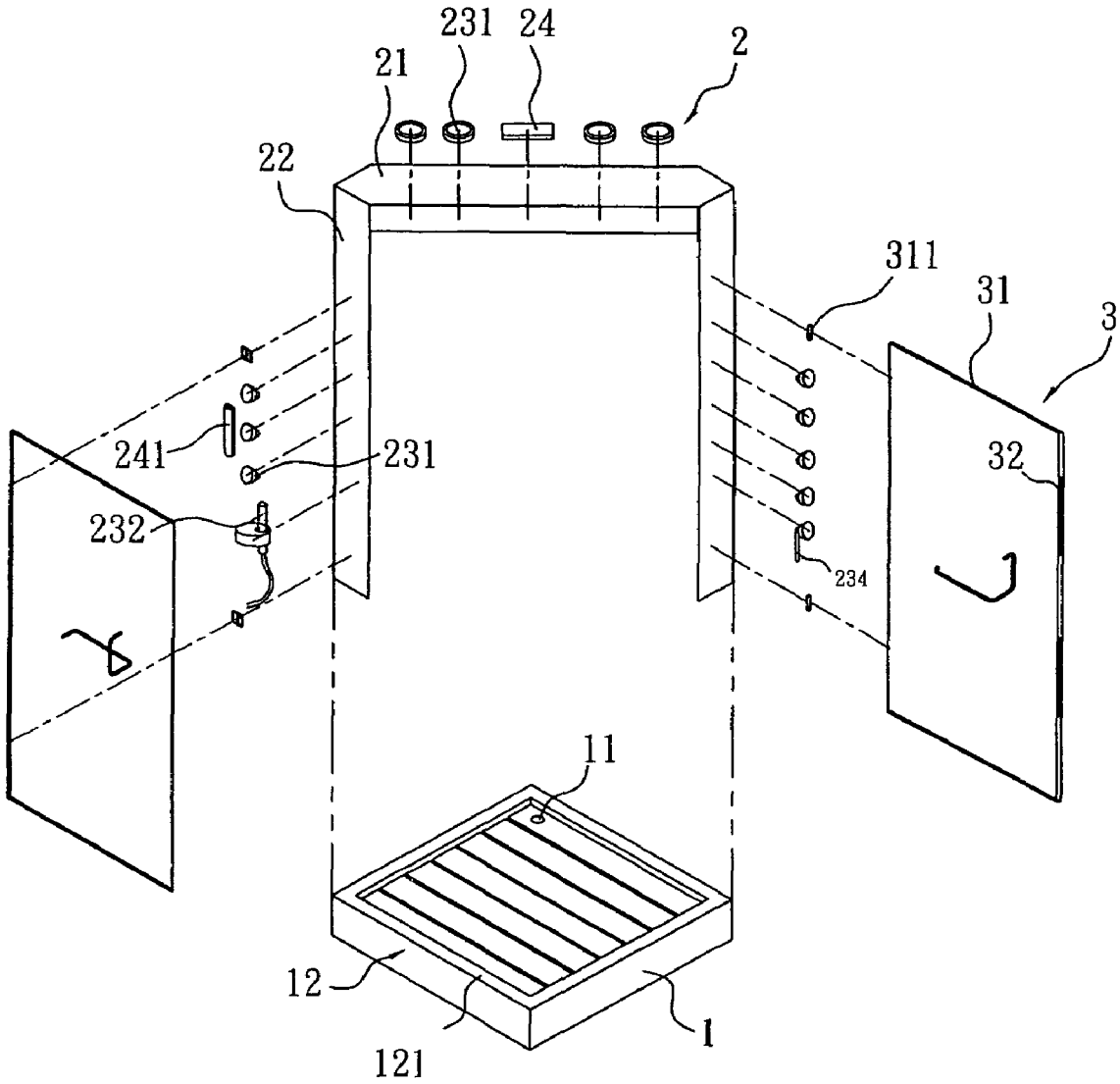
FIG. 2 is the explosive view.

Please refer to FIG. 1 and FIG. 2, which are a perspective view and an explosive view showing the preferred embodiment according to the present invention. As shown in the figures, the present invention is a shower apparatus using a saved space, comprising a base 1, a frame 2 and a gate body 3, where a space for the assembled shower apparatus is saved; and, by using spray device and illuminating device, a whole body is massaged and a relaxing atmosphere is obtained.

The base 1 has an outlet 11; the base 1 is surrounded by a stopper 12 on a rim of the base 1; and the stopper 12 has an incline 121 inside.

The frame 2 comprises a horizontal plate 21 and two side plates 22, where the side plates 22 are separately extending down from two opposite ends of the horizontal plate 21 to form the 'n'-shaped frame 2; and the side plates 22 are disposed on two interior opposite angles of a surface of the base 1. A surface of the horizontal plate 21 and a surface of each side plate 22, corresponding to the surface of the base 1, have a spray device 23 and an illuminating device 24, where the spray device 23 comprises a plurality of spray nozzles 231 on default places of the horizontal plate 21 and the side plates 22; a shower nozzle 232 connected with a hose; and a control valve 234 controlling the spray nozzles 231 and the shower nozzle 232. And the illuminating device 24 is connected with a control switch 241.

The gate body 3 comprises two gate plates 31 separately fixed on edges of the ends of the frame 2 by using hinges 311; the gate plates 31 separately have attracting members 32 at corresponding parts to close the gate plates 31 and to selectively attach two gate plates together at a corner of the base, When the gate plates are attached together, a triangular opening is formed by the frame and upper edges of the two gate plates; and the gate plate 31 is a glass plate, a plastic plate or a wood plate. Thus, a novel shower apparatus using a saved space is obtained.

Figure 3:
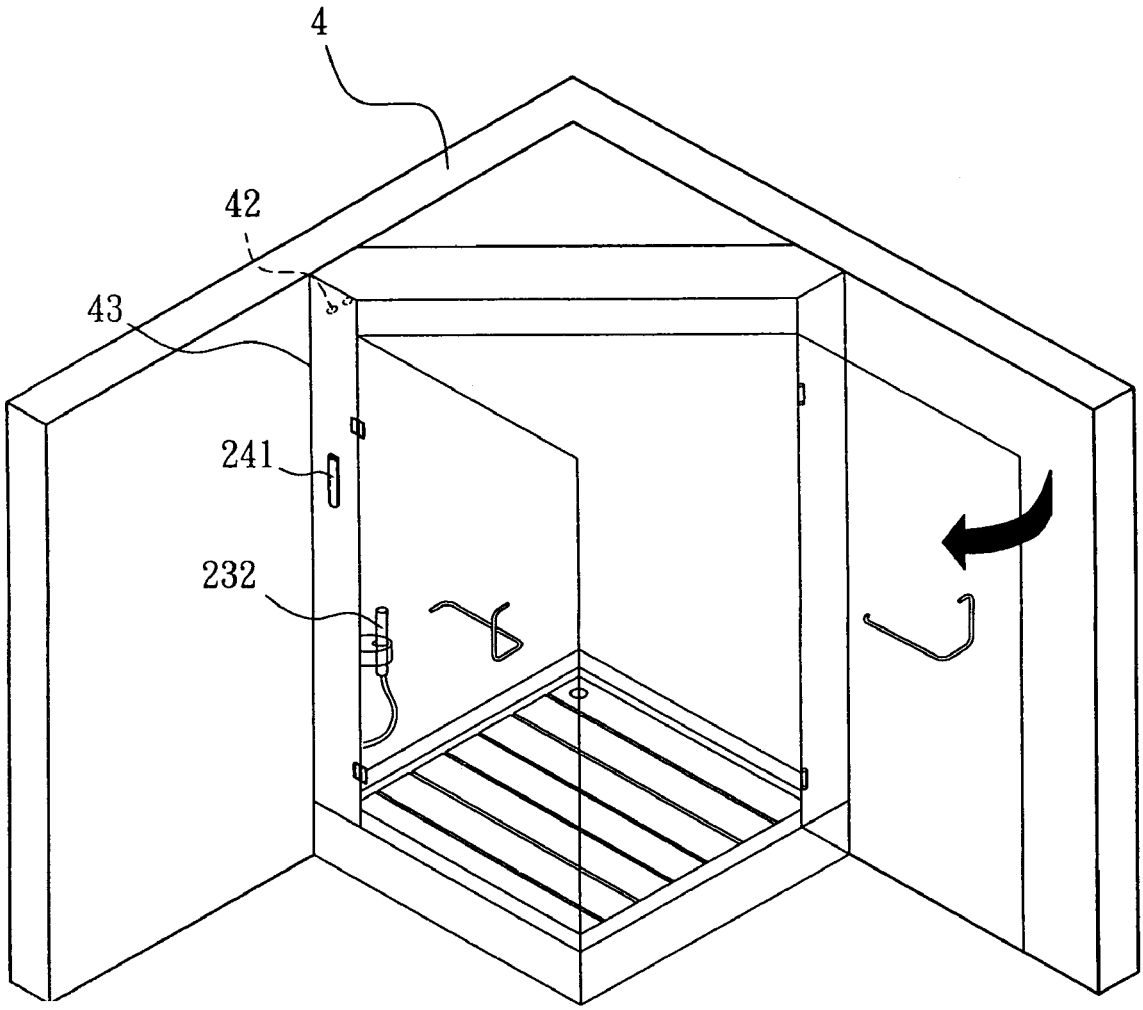
FIG. 3 is the view showing the assembly.
Figure 4:
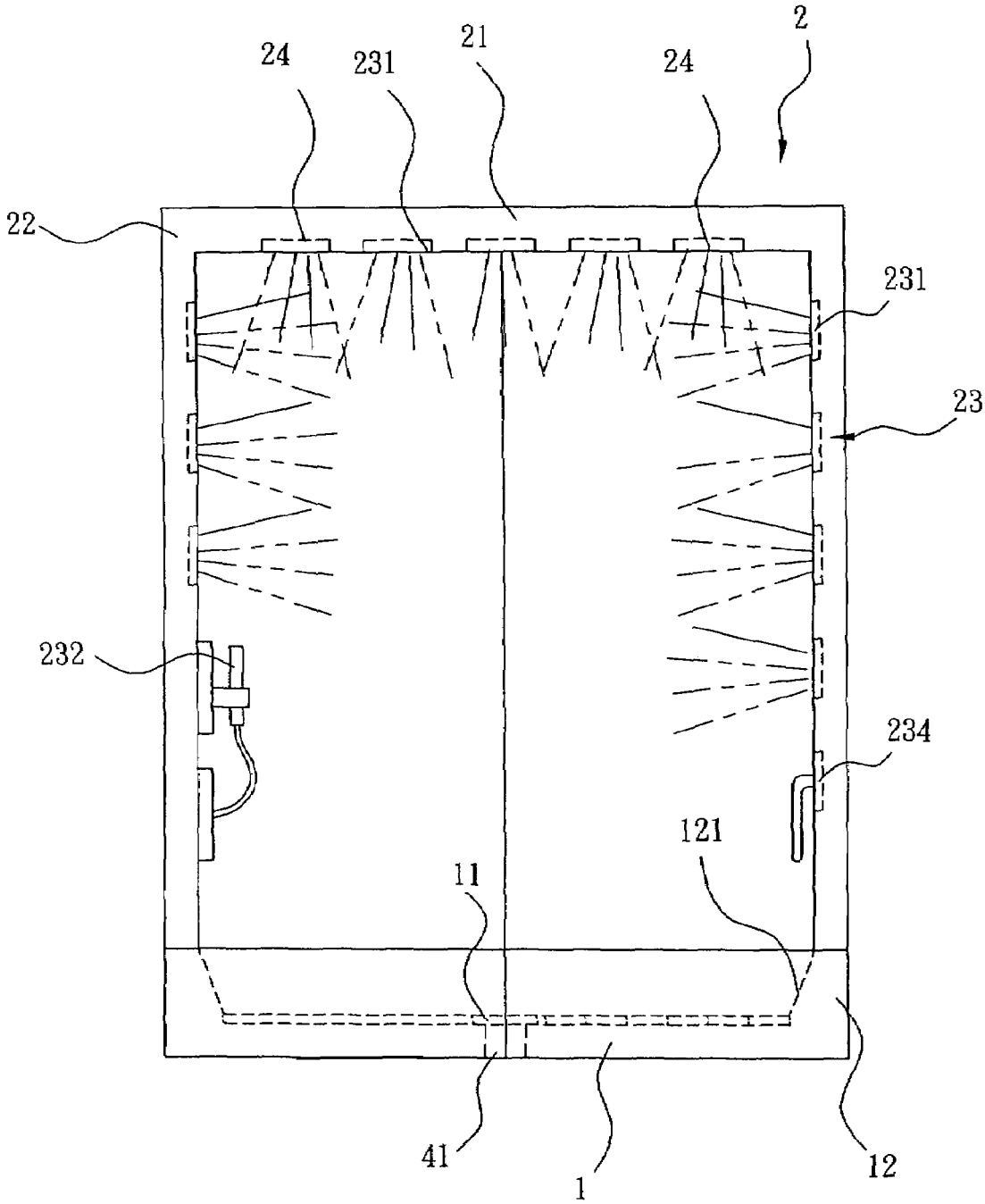
FIG. 4 is the sectional view showing the state of use.

Please refer to FIG. 3 and FIG. 4, which are a view showing an assembly; and a sectional view showing a state of use. As shown in the figures, when assembling the present invention, a base 1 is disposed at a corner where two walls 4 are connected. An outlet 11 of the base 1 is connected with a sinkhole 41. Two side plates 22 of a frame 2 are disposed on and corresponding to two interior opposite angles of a surface of the base 1. The side plates 22 are fixed to the wall 4 with a fixing device 42; and a colloid 43, like silicone, is applied to where the side plates 22 are connected with the walls 4. The spray device 23 is connected with an outside water-supplying system (not shown in the figures); and the illuminating device 24 is connected with an outside power source (not shown in the figures). Thus, a shower apparatus using a saved space according to the present invention is assembled at a corner of walls occupying a saved space.

When using the present invention, spray nozzles 231 are opened by a control valve 234 to massage a whole body; or a shower nozzle 232 is opened by the control valve 234 to have a shower. Or, the illuminating device 24 is switched on at the same time by a control switch 241 to obtain a relaxing atmosphere. And, when a shower is taken, water is prevented from leaking out by an incline 121 inside a stopper 12 surrounding the base 1.

To sum up, the present invention is a shower apparatus using a saved space, where the shower apparatus is assembled with a saved space; and, by using spray device and illuminating device, a whole body is massaged and a relaxing atmosphere is obtained.

The preferred embodiment herein disclosed is not intended to unnecessarily limit the scope of the invention. Therefore, simple modifications or variations belonging to the equivalent of the scope of the claims and the instructions disclosed herein for a patent are all within the scope of the present invention.

What is claimed is:

1. A shower apparatus using a saved space, comprising:

a base, said base having an outlet;

a frame, said frame having two opposite ends corresponding to two interior opposite angles of a surface of said base, said frame having a spray device and an illuminating device on a surface corresponding to said base; and a gate body, said gate body being disposed on edges of said ends of said frame, wherein said gate body comprises two gate plates separately fixed on said edges of said ends of said frame by using hinges, said two gate plates separately having attracting members at corresponding parts to selectively attach said two gate plates together at a corner of said base, wherein, when said gate plates are attached together, a triangular opening is formed by the frame and upper edges of the two gate plates, wherein said frame comprises a horizontal plate and two side plates, wherein said two side plates are separately extended from two ends of said horizontal plate in a direction to obtain an 'n'-shape for said frame, said frame arching over and across said base.

2. The apparatus according to claim 1, wherein said base is surrounded by a stopper; and wherein said stopper has an incline inside.

3. The apparatus according to claim 1, wherein said spray device is connected with an outside water-supplying system;

wherein said spray device comprises a plurality of spray nozzles, a shower nozzle and a control valve; and wherein said spray nozzles are disposed at positions on said frame, said shower nozzle is connected with a hose, and said control valve controls said spray nozzles and said shower nozzle.

4. The apparatus according to claim 1, wherein said illuminating device is connected with an outside power source; and wherein said illuminating device is electrically connected with a control switch.

5. The apparatus according to claim 1, wherein said gate plate is a glass plate.

6. The apparatus according to claim 1, wherein said gate plate is a plastic plate.

7. The apparatus according to claim 1, wherein said gate plate is a wood plate.

* * * * *